US009103535B1

(12) United States Patent
Strobel et al.

(10) Patent No.: US 9,103,535 B1
(45) Date of Patent: Aug. 11, 2015

(54) DECORATIVE LIGHTS INSTALLATION SYSTEMS

(71) Applicants: Joseph A. Nodland, Ottawa, IL (US); Molly Strobel, Ottawa, IL (US)

(72) Inventors: Christopher R. Strobel, Ottawa, IL (US); Joseph A. Nodland, Ottawa, IL (US)

( * ) Notice: Subject to any disclaimer, the term of this patent is extended or adjusted under 35 U.S.C. 154(b) by 144 days.

(21) Appl. No.: 13/834,307

(22) Filed: Mar. 15, 2013

Related U.S. Application Data

(60) Provisional application No. 61/613,033, filed on Mar. 20, 2012.

(51) Int. Cl.
*F21V 17/10* (2006.01)
*F21S 4/00* (2006.01)

(52) U.S. Cl.
CPC *F21V 17/10* (2013.01); *F21S 4/001* (2013.01)

(58) Field of Classification Search
CPC ..... F21V 17/10; F21S 4/001
USPC ..... 362/145, 147, 151, 152, 225, 224, 362/249.01, 249.06, 249.16, 376, 378, 369
See application file for complete search history.

(56) References Cited

U.S. PATENT DOCUMENTS

| | | | | |
|---|---|---|---|---|
| 2,986,627 | A * | 5/1961 | Marriett | 362/151 |
| 3,578,282 | A * | 5/1971 | Olsen | 248/214 |
| 3,861,632 | A * | 1/1975 | Siilats | 248/224.7 |
| 4,852,832 | A * | 8/1989 | Delaney | 248/65 |
| 5,510,966 | A * | 4/1996 | Konecny | 362/249.16 |
| 5,594,628 | A * | 1/1997 | Reuter et al. | 362/152 |
| 5,813,751 | A | 9/1998 | Shaffer | |
| 6,019,488 | A * | 2/2000 | Hastings | 362/374 |
| 6,076,938 | A * | 6/2000 | Kinderman | 362/145 |
| 6,363,662 | B1 | 4/2002 | Coates | |
| 6,955,458 | B2 | 10/2005 | Cheema | |
| 7,066,618 | B1 * | 6/2006 | Little | 362/147 |
| D620,189 | S | 7/2010 | Hill et al. | |
| 8,002,433 | B1 | 8/2011 | Cucksey et al. | |
| 2011/0038149 | A1 * | 2/2011 | Zlotnikov et al. | 362/235 |
| 2011/0164409 | A1 | 7/2011 | Smith et al. | |

* cited by examiner

*Primary Examiner* — John A Ward
(74) *Attorney, Agent, or Firm* — Goldstein Law Offices, P.C.

(57) ABSTRACT

A system including a J-shaped portion defined via an elongated trough and an elongated leg. The trough having an elongated inner channel. The leg having an elongated inner surface exposed to the inner channel. The J-shaped portion having a first elongated end at the trough and a second elongated end at the leg. The first end having an elongated grasping lip curving toward the inner channel. The inner surface having a plurality of decorative light holders stationed along the inner surface. The holders are disposed between the inner channel and the second end.

18 Claims, 11 Drawing Sheets

DECORATIVE LIGHTS INSTALLATION SYSTEMS

CROSS-REFERENCE TO RELATED APPLICATIONS

This application claims priority to U.S. Provisional Patent Application Ser. No. 61/613,033, filed on Mar. 20, 2012, which is herein incorporated by reference in its entirety for all purposes.

TECHNICAL FIELD

Generally, the present disclosure relates to decorative external lighting systems. More particularly, the present disclosure relates to decorative lights installation systems.

BACKGROUND

In the present disclosure, where a document, an act and/or an item of knowledge is referred to and/or discussed, whether directly and/or indirectly, then this reference and/or discussion is not an admission that the document, the act and/or the item of knowledge and/or any combination thereof was at the priority date, publicly available, known to the public, part of common general knowledge and/or otherwise constitutes prior art under the applicable statutory provisions and/or is known to be relevant to an attempt to solve any problem with which the present disclosure is concerned.

Christmas is a widely celebrated holiday among many people worldwide. A popular custom during the Christmas season is to install strands of decorative lights onto exterior surfaces of a home. The strands aesthetically enhance festive appearance of the home and are loved by children. However, installing such strands has traditionally been tortuous.

In order to properly install such strands, some people hire a professional. Yet, such situation is often undesirable since professional help can be expensive, especially over many annual installations. Also, such situation can be frustrating due to perceived minor return on investment, especially since the strands are usually taken down some time following New Year's Day.

An alternative to professional help is self-installation. However, some people, especially those who are not handy, struggle with ladders and repair tools. Consequently, such installation process can become time-consuming, complex and/or laborious, especially if the strands are tangled. Likewise, since the strands are usually taken down some time following New Year's Day, the installation process can be frustrating due to perceived minor benefit. Similarly, in colder geographical areas, the installation process can become more difficult.

Regardless of who installs the strands, undesirable consequences resulting from the installation process can include sicknesses from prolonged exposure to cold weather and injuries from falls from the ladders and/or from work accidents from the repair tools. Also, such consequences can include damage to the strands from repeated handling and/or marring of the exterior surfaces from repeated insertion and removal of various fasteners.

An alternative to annual installation is leaving the strands on the exterior surfaces year-round. However, such practice is aesthetically undesirable, especially since the lights are subject to deterioration from exposure to various weather conditions.

While certain aspects of conventional technologies have been discussed to facilitate the present disclosure, no technical aspects are disclaimed. The claims may encompass one and/or more of the conventional technical aspects discussed herein.

BRIEF SUMMARY

An example embodiment of the present disclosure is a system including a J-shaped portion defined via an elongated trough and an elongated leg. The trough having an elongated inner channel. The leg having an elongated inner surface exposed to the inner channel. The J-shaped portion having a first elongated end at the trough and a second elongated end at the leg. The first end having an elongated grasping lip curving toward the inner channel. The inner surface having a plurality of decorative light holders stationed along the inner surface. The holders are disposed between the inner channel and the second end.

Another example embodiment of the present disclosure is a system including an installed gutter having an elongated water channel and an elongated edge above the channel. The system including a strand of operating decorative lights. The system including a J-shaped portion defined via an elongated trough and an elongated leg. The trough having an elongated inner channel. The leg having an elongated inner surface exposed to the inner channel. The J-shaped portion having a first elongated end at the trough and a second elongated end at the leg. The first end having an elongated lip curving toward the inner channel. The lip grasping at least a section of the edge such that the J-shaped portion hangs from the gutter. The inner surface having a plurality of decorative light holders stationed along the inner surface. The holders are disposed between the inner channel and the second end. The holders holding the lights such that the lights avoid contact with the gutter. The lights illuminating downward and away from the inner channel.

The present disclosure may be embodied in the form illustrated in the accompanying drawings. Attention is called to the fact, however, that the drawings are illustrative. Variations are contemplated as being part of the disclosure, limited only by the scope of the claims.

BRIEF DESCRIPTION OF THE DRAWINGS

The accompanying drawings, which are incorporated into and form a part of the specification, illustrate example embodiments of the present disclosure. Together with the detailed description, the drawings serve to explain the principles of the present disclosure. The drawings are only for the purpose of illustrating example embodiments of the present disclosure and are not to be construed as necessarily limiting the disclosure. The above and other objects, aspects, advantages and features of the present disclosure will become better understood to one skilled in the art with regard to the following description, appended claims and accompanying drawings where:

DETAILED DESCRIPTION OF THE PREFERRED EMBODIMENTS

Figure 1:
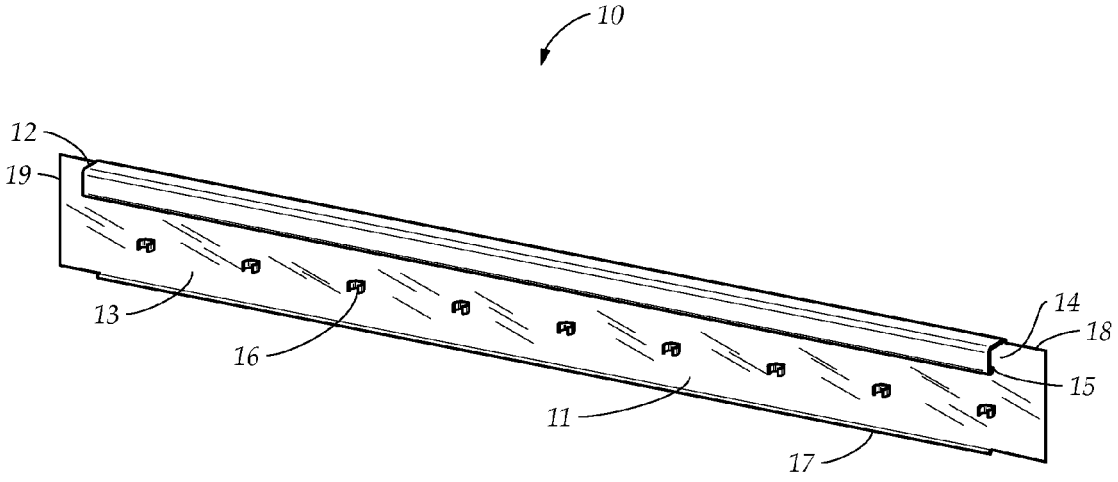
FIG. 1 shows a perspective view of an example embodiment of a decorative lights installation system according to the present disclosure.

The present disclosure will now be described more fully with reference to the accompanying drawings, in which example embodiments of the disclosure are shown. The disclosure may, however, be embodied in many different forms and should not be construed as being limited to the embodiments set forth herein. Rather, these embodiments are provided so that this disclosure will be thorough and complete, and will fully convey the concept of the disclosure to those skilled in the art. Also, features described with respect to certain embodiments may be combined in various other embodiments. Different aspects and elements of the embodiments may be combined in a similar manner.

Any verbs as used herein can imply direct or indirect, full or partial, action or inaction. For example, when an element is referred to as being "on," "connected" or "coupled" to another element, then the element can be directly connected or coupled to the other element or intervening elements may be present. In contrast, when an element is referred to as being "directly connected" or "directly coupled" to another element, there are no intervening elements present.

Although the terms first, second, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present disclosure.

The terminology used herein is for the purpose of describing particular embodiments only and is not intended to be necessarily limiting of the disclosure. As used herein, the singular forms "a," "an" and "the" are intended to include the plural forms as well, unless the context clearly indicates otherwise. The terms "comprises," "includes" and/or "comprising," "including" when used in this specification, specify the presence of stated features, integers, steps, operations, elements, and/or components, but do not preclude the presence or addition of one or more other features, integers, steps, operations, elements, components, and/or groups thereof.

Example embodiments of the disclosure are described herein with reference to illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims. Any components and/or materials can be formed from a same, structurally continuous piece and/or be separately manufactured and/or connected.

Unless otherwise defined, all terms (including technical and scientific terms) used herein have the same meaning as commonly understood by one of ordinary skill in the art to which this disclosure belongs. The terms, such as those defined in commonly used dictionaries, should be interpreted as having a meaning that is consistent with their meaning in the context of the relevant art and will not be interpreted in an idealized or overly formal sense unless expressly so defined herein.

Furthermore, relative terms such as "below," "lower," "above," and "upper" may be used herein to describe one element's relationship to another element as illustrated in the accompanying drawings. Such relative terms are intended to encompass different orientations of the device in addition to the orientation depicted in the accompanying drawings. For example, if the device in the accompanying drawings is turned over, elements described as being on the "lower" side of other elements would then be oriented on "upper" sides of the other elements. Similarly, if the device in one of the figures is turned over, elements described as "below" or "beneath" other elements would then be oriented "above" the other elements. Therefore, the example terms "below" and "lower" can, therefore, encompass both an orientation of above and below.

Any and/or all elements as disclosed herein can be unitary, non-unitary, electrically and/or thermally insulating, electrically and/or thermally conductive, magnetic, non-magnetic, rigid, flexible, aligned, misaligned, symmetrical, asymmetrical, linear, non-linear, wavy, non-wavy, identical in length, width, height, depth and/or weight, non-identical in length, height, width, depth and/or weight, for single use, reusable, smooth, rough, flush, non-flush, even leveled, non-even leveled with respect to any and/or all other elements as disclosed herein and/or any combination thereof.

FIG. 1 shows a perspective view of an example embodiment of a decorative lights installation system according to the present disclosure.

A decorative lights installation system 10 is used for installing a strand of decorative lights onto a rain gutter having a longitudinal edge. Any and/or all elements and/or sub-elements of system 10 can be formed from a same, structurally continuous piece and/or be separately fabricated and connected. Any and/or all elements or sub-elements of system 10 can include metal, vinyl, plastic, rubber, wood and/or any other equivalent material. Any and/or all elements and/or sub-elements of system 10 can be rigid and/or flexible. As a whole, system 10 is lightweight so as avoid exerting excessive weight on the gutter, yet sturdy so as to provide secure grip, stability and/or balance. System 10 can be used for the entire gutter or a section of the gutter.

System 10 includes a J-shaped sheet 11 defined by a trough portion 12 extending from a leg portion 13. Trough portion 12 defines a channel 14 therein. Sheet 11 has a first end at trough portion 12 and a second end at leg portion 13.

Trough portion 12 can be U-shaped, V-shaped or any other shape defining channel 14 therein. Trough portion 12 can be rounded, sharp and/or any combination thereof. Trough portion 12 can be wholly continuous or have at least one through hole configured for receipt of a fastener, such as a screw or a bolt, to fasten trough portion 12 to the gutter. Trough portion 12 can also be segmented into a plurality of trough segments with a plurality of openings therebetween.

Leg portion 13 can be rectangular, square, circular, trapezoidal, triangular or any other shape. Leg portion 13 can include a through hole configured for receipt of a fastener, such as a screw or a bolt, to fasten leg 13 to the gutter. Leg portion 13 can include a mating portion of a hook-and-loop fastener. Leg portion 13 can include triangular, linear or curved corners.

System 10 also includes a lip 15 configured for securely grasping the longitudinal edge of the rain gutter. Lip 15 extends from the first end at trough portion 12. Lip 15 curves towards channel 14. Lip 15 can be C-shaped, U-shaped, V-shaped or any other shape configured for securely grasping the edge. Lip 15 can be sized and shaped in order to snap around the edge.

Any and/or all portions of lip 15, trough portion 12, leg portion 13 and/or channel 14 can include a friction enhancing coating, such as rubber, for increasing friction between the gutter and lip 15, trough portion 12, leg portion 13 and/or channel 14. Any and/or all portions of lip 15, trough portion 12, leg portion 13 and/or channel 14 can include an adhesive coating, which can be waterproof, configured for securely adhering onto the gutter. Any portion of trough portion 12 can be perforated to define an opening in trough 12 through which the rain gutter is visible and a bracket or a spike-and-ferrule hanger avoids interference with system 10. Trough 12 can include a mating portion of a hook-and-loop fastener.

System 10 further includes a plurality of decorative light holders 16 configured for holding the decorative lights of the strand. Leg portion 13 includes holders 16, which extend along and protrude from leg portion 13, between the second end at leg portion 13 and channel 14. Holders 16 are exposed to channel 14 and covered by trough 12 so as to protect holders 16 from various weather conditions. When lip 15 grasps the edge, then holders 16 are stationed along the gutter and avoiding contact with the gutter. Holders 16 can be C-shaped, V-shaped, U-shaped or any other similar function shape clips. Holders 16 can be mating holders, such as a hook-and-loop fastener. Holders 16 can be biased so as to secure the lights via application of pressure. Holders 16 can also include weatherproof adhesives.

Leg portion 10 can include a rib portion 17 extending along the second end at leg portion 13. Rib portion 17 is used for strength of leg portion 13. Rib portion 17 can be wholly continuous or segmented. When lip 15 securely grasps the edge and holders 16 hold the decorative lights of the strand, then rib portion 17 avoids blocking light emanating from the lights.

Leg portion 13 can include a right side portion 18 to allow for overlap with another decorative lights installation system and a left side portion 19 to allow for overlap with yet another decorative lights installation system. Although side portion 18 extends away from trough portion 12 and rib portion 17, side portion 18 can include trough portion 12 or rib portion 17. Although side portion 19 extends away from trough portion 12 and rib portion 17, side portion 19 can include trough portion 12 or rib portion 17. Side portion 18 and side portion 19 can be identical or different from each other in size, material and/or shape. Likewise, system 10 can include only one of side portion 18 and side portion 19.

Figure 2:
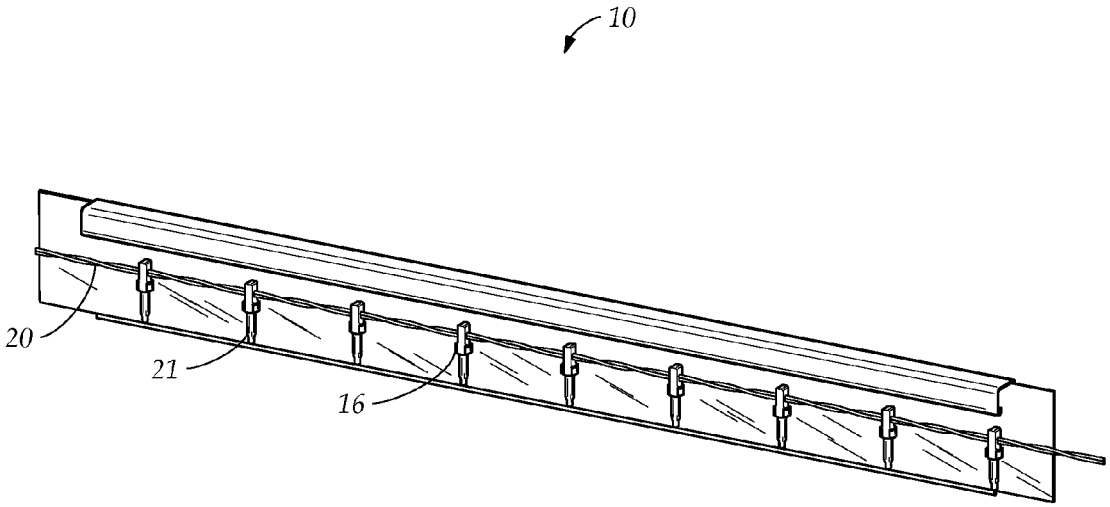
FIG. 2 shows a perspective view of an example embodiment of a decorative lights installation system with a strand of decorative lights according to the present disclosure.

FIG. 2 shows a perspective view of an example embodiment of a decorative lights installation system with a strand of decorative lights according to the present disclosure. Some elements of this figure are described above. Thus, same reference characters identify same or like components described above and any repetitive detailed description thereof will hereinafter be omitted or simplified in order to avoid complication.

A strand 20 of decorative lights 21 extends along leg portion 13. Although lights 21 can be incandescent or light emitting diodes (LED), other types of lights can also be employed, such as fluorescent. Each light 21 is held by holder 16 and covered from outside weather by trough portion 12. Hence, lights 21 are protected from sunlight or various weather conditions, such as rain, wind, hail or snow. However, holders 16 can be positioned on side portion 18 and/or side portion 19 as well.

Figure 3:
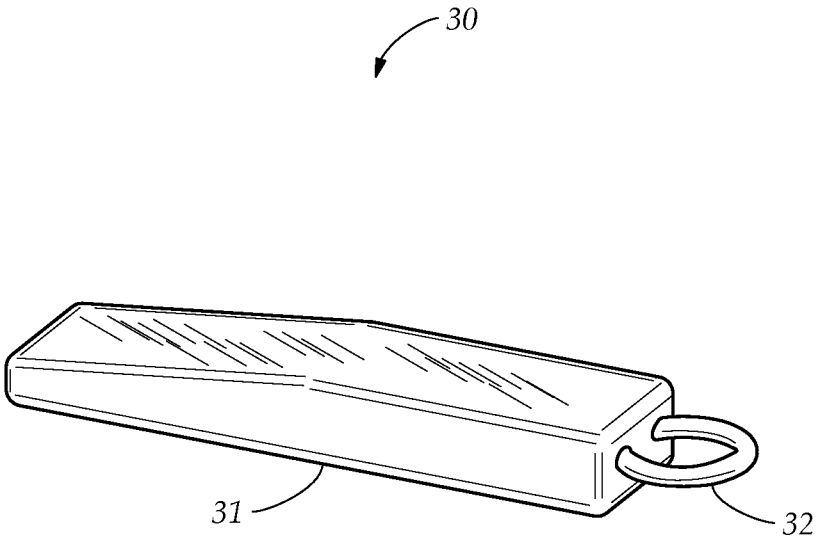
FIG. 3 shows a perspective view of an example embodiment of a side block according to the present disclosure.

FIG. 3 shows a perspective view of an example embodiment of a side block according to the present disclosure. Some elements of this figure are described above. Thus, same reference characters identify same or like components described above and any repetitive detailed description thereof will hereinafter be omitted or simplified in order to avoid complication.

A side block 30 is used for raising system 10 with respect to the rain gutter. Any and/or all elements and/or sub-elements of block 30 can be formed from a same, structurally continuous piece and/or be separately fabricated and connected. Any and/or all elements and/or sub-elements of block 30 can include metal, vinyl, foam, plastic, rubber, wood and/or any other equivalent material. Any and/or all elements and/or sub-elements of block 30 can be rigid and/or flexible. As a whole, block 30 is lightweight so as avoid exerting excessive weight on the gutter.

Block 30 includes a body 31. Although body 31 is ramp shaped, body 31 can be of any shape, such as a cube, a cylinder, a cuboid, a prism or others. Block 30 can be a strip.

In an alternative example embodiment, sheet 11 includes block 30.

Block 30 includes a handle 32. Although handle 32 is C-shaped, handle 32 can be of any shape, such as an O-shape, a T-shape, a D-shape, a U-shape, a V-shape or others.

Figure 4:
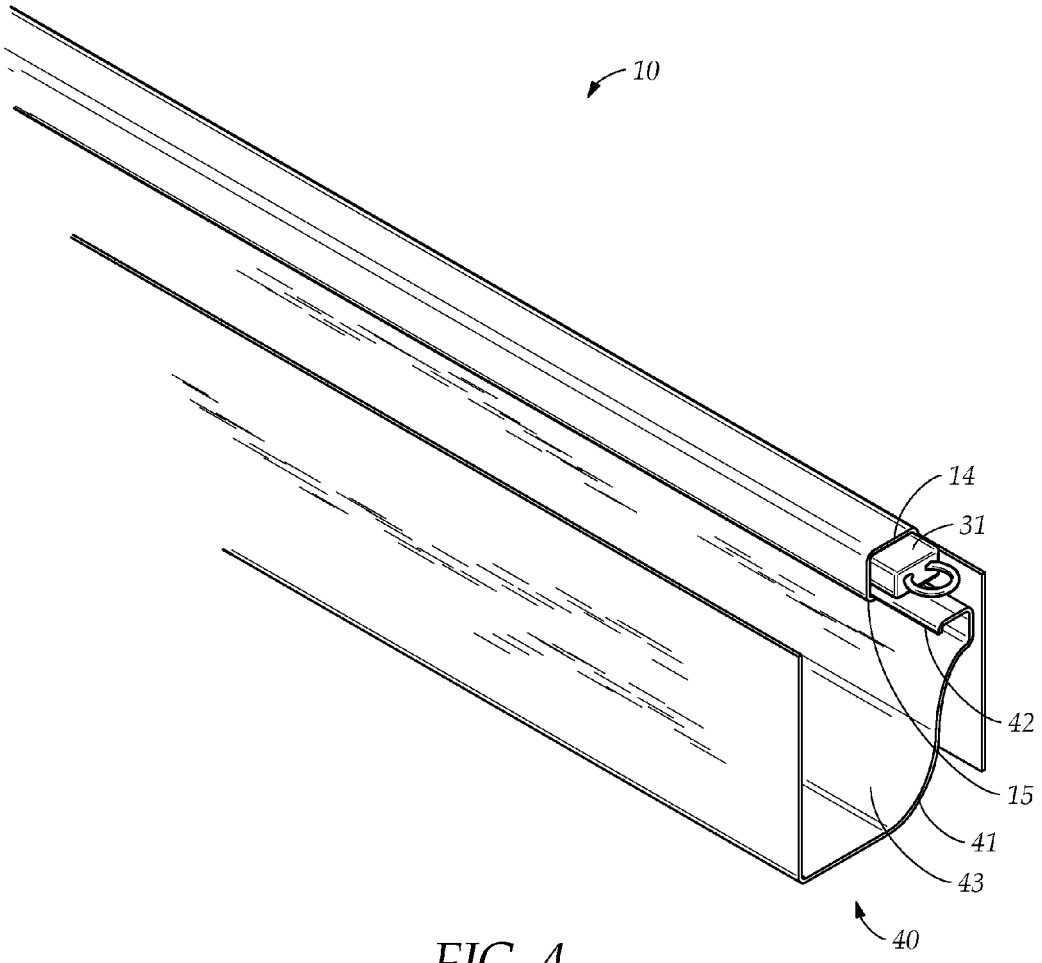
FIG. 4 shows a perspective view of an example embodiment of a side block employed with a decorative lights installation system engaging a rain gutter according to the present disclosure.

FIG. 4 shows a perspective view of an example embodiment of a side block employed with a decorative lights installation system engaging a rain gutter according to the present disclosure. Some elements of this figure are described above. Thus, same reference characters identify same or like components described above and any repetitive detailed description thereof will hereinafter be omitted or simplified in order to avoid complication.

A rain gutter 40 includes a body 41 having a water channel 43 therein. Body 41 has a longitudinal edge 42 extending along water channel 43.

Lip 15 is configured for securely grasping edge 42. Lip 15 extends from the first end at trough portion 12 and curves towards channel 14.

Although channel 14 is sized and shaped to receive block 30, channel 14 can be sized and shaped such that block 30 is incapable of placement or proper placement into channel 14, such as when channel 14 contacts the gutter. When channel 14 receives block 30, sheet 11 is raised with respect to body 41. When channel 14 houses block 30, sheet 11 is more stable and balanced than without block 30. Channel 14 can be sized and shape to house a plurality of blocks 30, such as when blocks 30 are stacked or placed adjacent to each other. When desired, a user can remove block 30 via handle 32.

Figure 5:
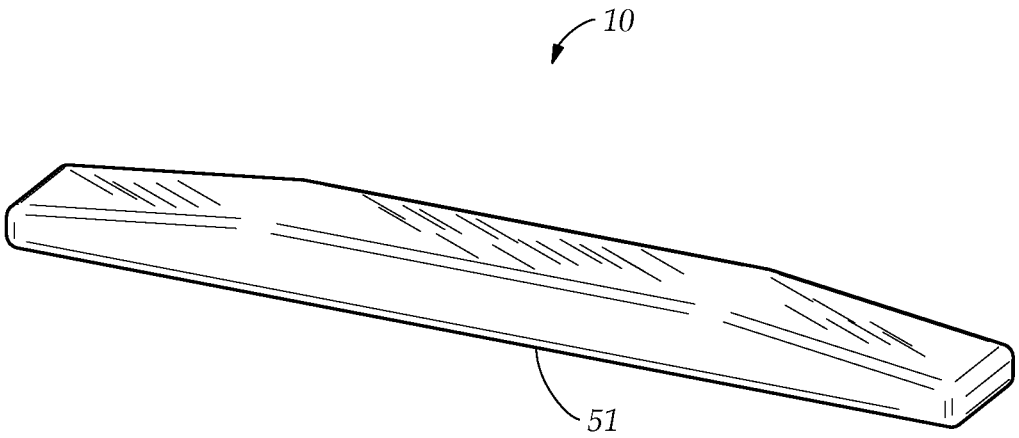
FIG. 5 shows a perspective view of an example embodiment of an intermediate block according to the present disclosure.

FIG. 5 shows a perspective view of an example embodiment of an intermediate block according to the present disclosure. Some elements of this figure are described above. Thus, same reference characters identify same or like components described above and any repetitive detailed description thereof will hereinafter be omitted or simplified in order to avoid complication.

An intermediate block 50 is used for raising system 10 with respect to the rain gutter. Any and/or all elements and/or sub-elements of block 50 can be formed from a same, structurally continuous piece or be separately fabricated and connected. Any and/or all elements and/or sub-elements of block 50 can include metal, vinyl, foam, plastic, rubber, wood or any other equivalent material. Any and/or all elements and/or sub-elements of block 50 can be rigid and/or flexible. As a whole, block 50 is lightweight so as avoid exerting excessive weight on the gutter.

Block 50 includes a body 51. Although body 51 is double-ramp shaped, body 51 can be of any shape, such as a cube, a cylinder, a cuboid, a prism or other shapes. Block 50 can be a strip. Block 50 can be placed adjacent to or stacked onto block 30 and visa versa.

Figure 6:
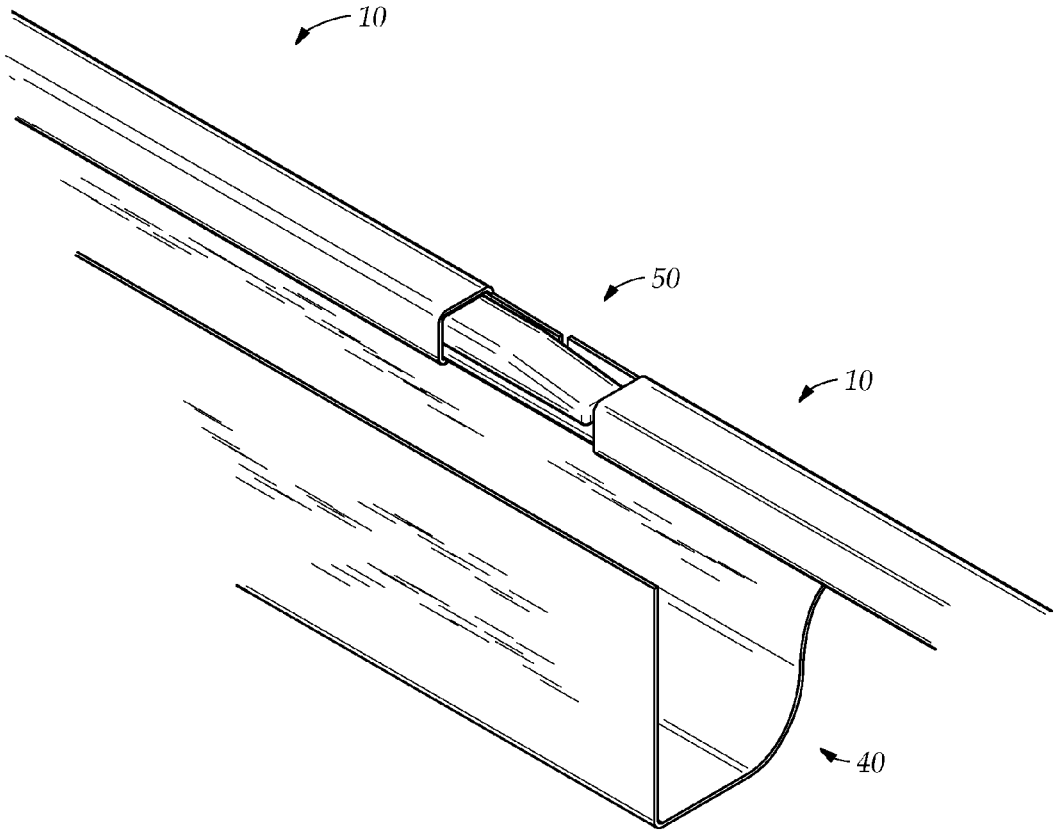
FIG. 6 shows a perspective view of an example embodiment of an intermediate block employed with a pair of decorative lights installation systems engaging a rain gutter according to the present disclosure.

FIG. 6 shows a perspective view of an example embodiment of an intermediate block employed with a pair of decorative lights installation systems engaging a rain gutter according to the present disclosure. Some elements of this figure are described above. Thus, same reference characters identify same or like components described above and any repetitive detailed description thereof will hereinafter be omitted or simplified in order to avoid complication.

Block 50 is used to interconnect a plurality of adjacent systems 10 mounted on gutter 40. A portion of block 50 is housed within channel 14 of one of systems 10 and a portion of block 50 is about to be housed within channel 14 of another of systems 10. Hence, more balancing and stability to systems 10 is provided. Although channels 14 are sized and shaped to receive blocks 50, channels 14 can be sized and shaped such that blocks 50 are incapable of placement or proper placement into channels 14, such as when channels 14 contact the gutter.

In an alternative example embodiment, sheet 11 includes block 50.

In another alternative example embodiment, channel 14 can be sized and shape to house a plurality of blocks 50, such as when blocks 50 are stacked or placed adjacent to each other.

Figure 7:
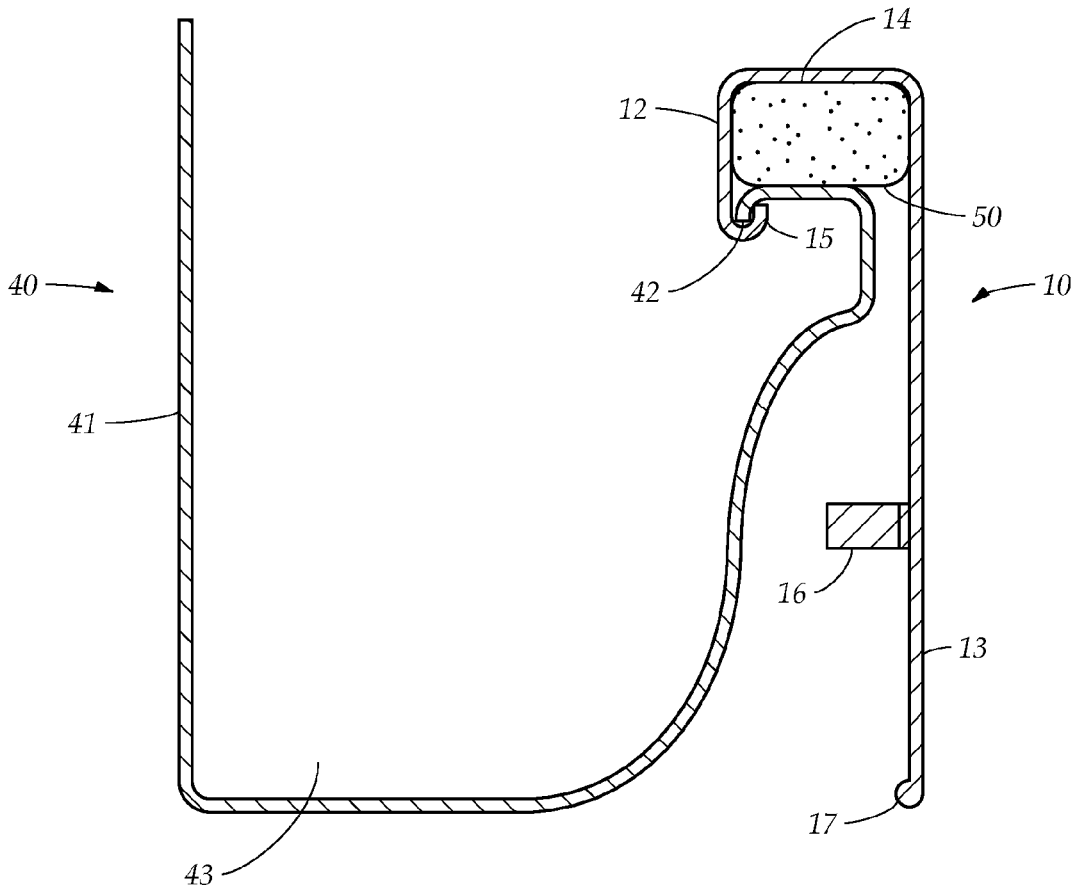
FIG. 7 shows a side view of an example embodiment of a decorative lights installation system engaging a rain gutter and employing an intermediate block according to the present disclosure.

FIG. 7 shows a side view of an example embodiment of a decorative lights installation system engaging a rain gutter and employing an intermediate block according to the present disclosure. Some elements of this figure are described above. Thus, same reference characters identify same or like components described above and any repetitive detailed description thereof will hereinafter be omitted or simplified in order to avoid complication.

J-shaped sheet 11 defined by trough portion 12 extending from leg portion 13. Trough portion 12 defines channel 14 therein. Sheet 11 has a first end at trough portion 12 and a second end at leg portion 13. Although leg portion 13 is linear with respect to trough portion 12, leg portion 13 can incline, whether outwardly away from gutter 40 and/or channel 14 and/or inwardly towards gutter 40 and/or channel 14, from trough portion 12 within about 10 degrees each way for a total range of inclination of about 20 degrees. Lip 15 securely grasps edge 42. Lip 15 extends from the first end and curves towards channel 14. Decorative light holders 16 are configured for holding the decorative lights of the strand. Leg portion 13 includes holders 16 between the second end and channel 14. Holders 16 are stationed along gutter 40 avoiding contact with gutter 40.

Rib portion 17 extends along the second end at leg portion 13. When holders 16 hold the lights, then rib portion 17 avoids blocking light emanating from the lights.

Block 50 raises system 10 with respect to rain gutter 40 away from water channel 43. As a whole, system 10 and block 50 are lightweight so as avoid exerting excessive weight on gutter 40, yet sturdy so as to provide secure grip, stability and/or balance.

Figure 8:
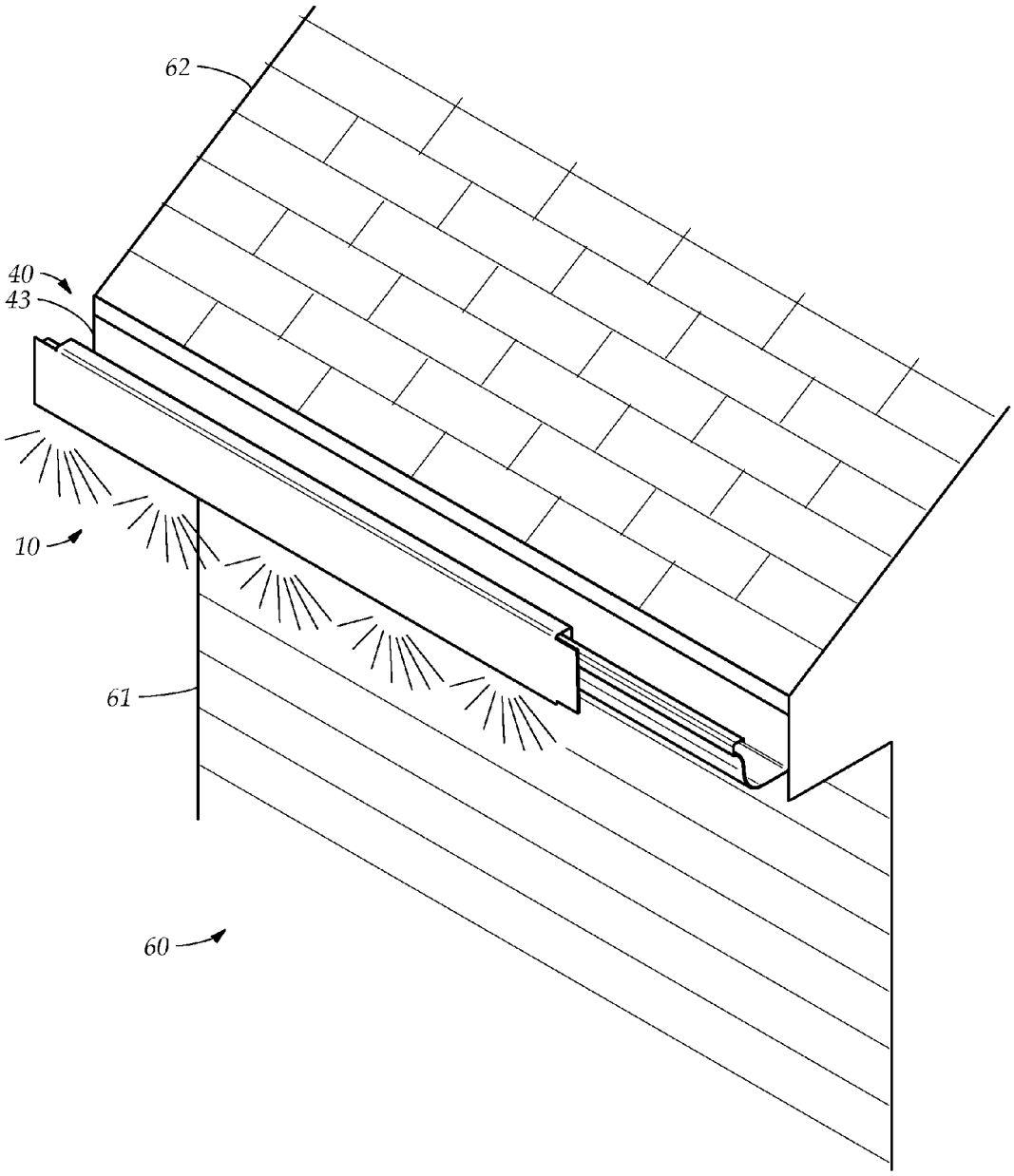
FIG. 8 shows a perspective view of an example embodiment of a decorative lights installation system engaging a rain gutter of a residential home having an inclined roof according to the present disclosure.

FIG. 8 shows a perspective view of an example embodiment of a decorative lights installation system engaging a rain gutter of a residential home having an inclined roof according to the present disclosure. Some elements of this figure are described above. Thus, same reference characters identify same or like components described above and any repetitive detailed description thereof will hereinafter be omitted or simplified in order to avoid complication.

A home 60 includes a wall 61 and an inclined roof 62. When rainwater flows from roof 62 onto water channel 43 or rain drops fall into water channel 43, the rainwater and the rain drops flow through and out of water channel 43, while avoiding contact with lights 21 held by holders 16. Portion 17 avoids blocking light emanating from the lights. Although home 60 is residential, other types of buildings, whether residential, commercial, industrial and/or any other can be used as well. Also, although roof 62 is inclined, other types of roofs can also be used. Moreover, system 10 can be used with any gutter, irrespective of building, wall or roof type, such as for example even on fences or vehicles, whether ground, marine or air.

Figure 9:
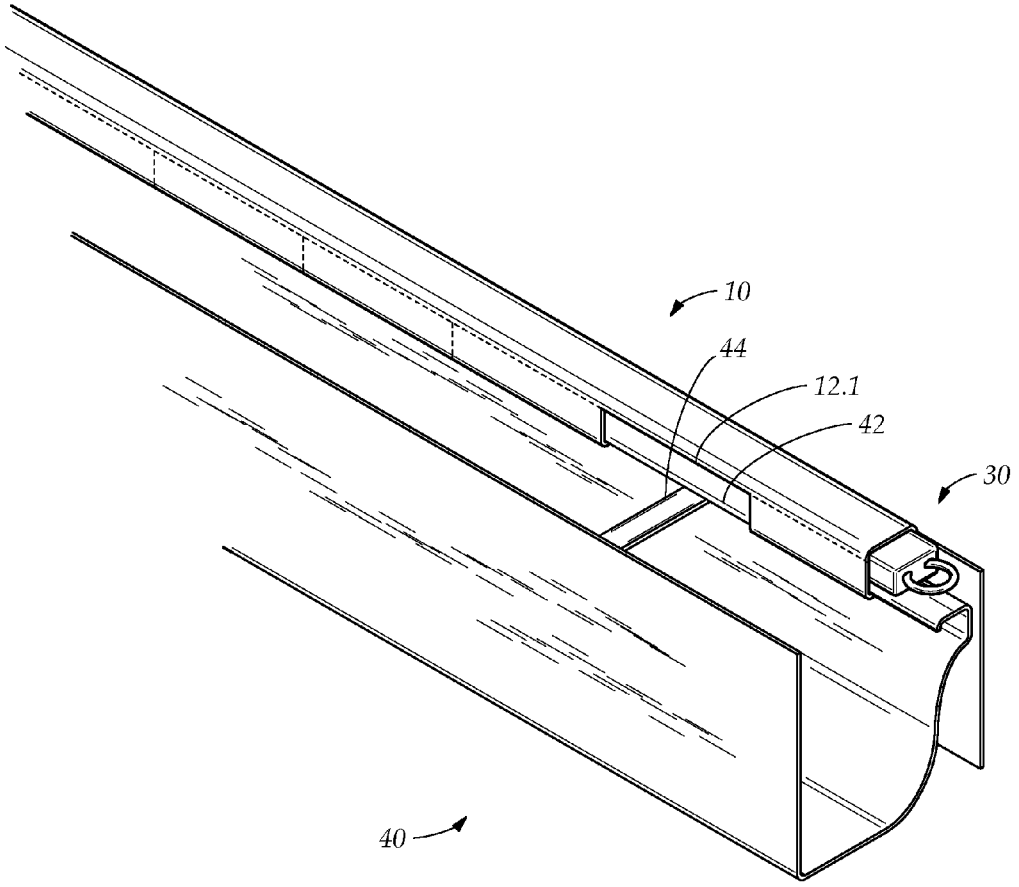
FIG. 9 shows a perspective view of an example embodiment of a decorative lights installation system engaging a rain gutter with a bracket or a spike-and-ferrule hanger according to the present disclosure.

FIG. 9 shows a perspective view of an example embodiment of a decorative lights installation system engaging a rain gutter with a bracket or a spike-and-ferrule hanger according to the present disclosure. Some elements of this figure are described above. Thus, same reference characters identify same or like components described above and any repetitive detailed description thereof will hereinafter be omitted or simplified in order to avoid complication.

Body 41 includes a bracket or a spike-and-ferrule hanger 44 extending over water channel 43. Trough 12 includes an opening 12.1 such that hanger 44 avoids interference with secure grasp of lip 15. Hence, edge 42 can be visible within opening 12.1. Also, if block 30 or 50 is housed within channel 14, then a portion of block 30 or 50 sometimes can be visible through opening 12.1.

Channel 14 can house a plurality of blocks 30 or 50 in order to provide balance and stability to system 10.

Figure 10A:
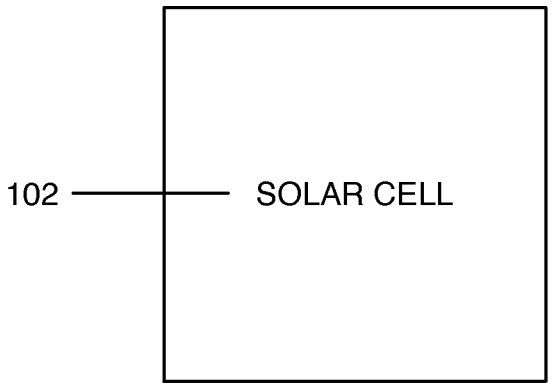
FIG. 10A shows a top view of a square solar cell according to the present disclosure.

FIG. 10A shows a top view of a square solar cell according to the present disclosure.

A square solar cell 102 is operative to receive light energy, such as solar light, moon light, light post light, headlights light, house light or decorative bulb light, and convert the received light energy into electricity. Cell 102 can also be shaped in other ways, such as circular. Cell 102 is operative for securing onto trough portion 12 and/or leg portion 13. Such securing can be on any side or surface of trough portion 12 and/or leg portion 13 as long as cell 102 is operative to receive light energy. More than one cell 102 can be used, such as in a pattern, like a line. Cell 102 is lightweight so as avoid exerting excessive weight on the gutter. Cell 102 can be configured to face the sun and generate electric current. Cell 102 can be a part of a solar panel having a plurality of solar cells.

Figure 10B:
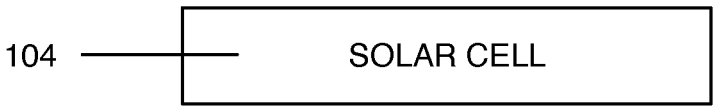
FIG. 10B shows a top view of a rectangular solar cell according to the present disclosure.

FIG. 10B shows a top view of a rectangular solar cell according to the present disclosure. Some elements of this figure are described above. Thus, same reference characters identify same or like components described above and any repetitive detailed description thereof will hereinafter be omitted or simplified in order to avoid complication.

A rectangular solar cell 104 functions similarly to cell 102. Cell 104 can extend along the gutter on any side or surface of trough portion 12 and/or leg portion 13 as long as cell 104 is operative to receive light energy. More than one cell 104 can be used, such as in a pattern, like a line. Cell 104 is lightweight so as avoid exerting excessive weight on the gutter. Cell 104 can be a solar panel having a plurality of solar cells.

Figure 11:
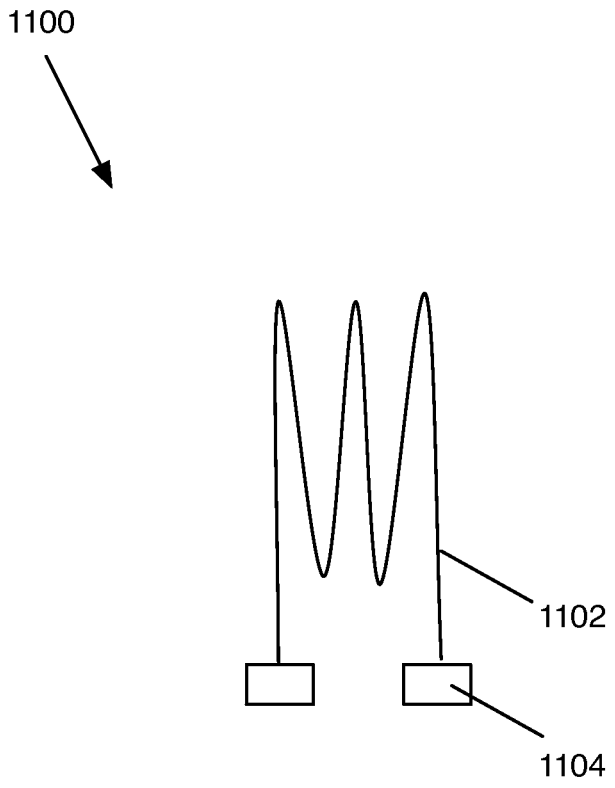
FIG. 11 shows a schematic view of a heating element according to the present disclosure.

FIG. 11 shows a schematic view of a heating element according to the present disclosure.

A heating element 1100 is operative to convert electricity into heat. Element 1100 is operative to receive electric current through an input 1104 for directing to an element body 1102, which resists the current and results in heating of body 1102. Body 1102 can include a wire, a ribbon, straight or coiled. Body 1102 can have other shapes, such as circular, rectangular and others. The heat is sufficiently thermal so as not to injure or kill people or animals or cause fire formation, spark formation or flame formation with any nearby flammable material, such as gutter debris, leaves or tree branches. The heat is also sufficiently thermal so as to facilitate reduction and/or prevention of at least one of snow accumulation, ice formation and icicle formation on at least one of on lip 15, channel 14, holder 16, portion 18, portion 19, portion 17, portion 12 and portion 13.

Element 1100 is operative for securing onto trough portion 12 and/or leg portion 13. Such securing can be on any side or surface of trough portion 12 and/or leg portion 13 as long as element 1100 is operative to generate heat and conduct the generated heat via at least one of trough portion 12 and/or leg portion 13. Element 1100 can be positioned to avoid wind exposure or contact with snow or water, such as rain, melted snow or ice. More than one element 1100 can be used, such as in a pattern, like a line. Element 1100 is lightweight so as avoid exerting excessive weight on the gutter.

In one mode of operation, sheet 11 is thermally conductive and can include or be coupled to heating element 1100, which can be powered by the strand or some other power source. Also, heating element 1100 can be powered by coupling to a solar cell, like cell 102 and/or cell 104, which can receive light energy from light emanated from the strand when the strand is attached to a powerline or other light sources. Thus, when snow or ice accumulates on system 10 thereby exerting excessive weight on gutter 40 and the heating element is activated, whether manually or automatically, then heating element 1100 generates heat and conducts the generated heat in system 10 such that the snow and the ice melt or are prevented from freezing or accumulating.

Resultantly, via installation of system 10, the lights can be accessible anytime, such as for bulb replacement. Also, via system 10, the lights can be displayed throughout the year or on other holidays besides Christmas.

The description of the present disclosure has been presented for purposes of illustration and description, but is not intended to be fully exhaustive and/or limited to the disclosure in the form disclosed. Many modifications and variations in techniques and structures will be apparent to those of ordinary skill in the art without departing from the scope and spirit of the disclosure as set forth in the claims that follow. Accordingly, such modifications and variations are contemplated as being a part of the present disclosure. The scope of the present disclosure is defined by the claims, which includes known equivalents and unforeseeable equivalents at the time of filing of this application.

What is claimed is:

1. A system comprising:

a J-shaped portion defined via an elongated trough and an elongated leg, the trough having an elongated inner channel, the leg having an elongated inner surface exposed to the inner channel, the J-shaped portion is thermally conductive and including a heating element, the J-shaped portion having a first elongated end at the trough and a second elongated end at the leg, the first end having an elongated grasping lip curving toward the inner channel, the inner surface having a plurality of decorative light holders stationed along the inner surface, the holders are disposed between the inner channel and the second end.

2. The system of claim 1, wherein the leg having at least one side portion extending beyond the trough, the at least one side portion co-planar with the inner surface.

3. The system of claim 1, wherein the second end having an elongated rib.

4. The system of claim 1, further comprising a block operative for placing into the channel, the block operative to provide stabilizing support to the J-portion.

5. The system of claim 4, wherein the block includes a ramped side.

6. The system of claim 4, wherein the block includes a handle such that the handle can be used to slide the block from the channel when pulled by the handle.

7. The system of claim 1, wherein the lip is longitudinally segmented with a plurality of openings therebetween.

8. The system of claim 7, wherein the trough above is longitudinally segmented according to the lip such that the block is visible when the block is in the channel.

9. The system of claim 1, wherein the lip includes at least one of a friction enhanced material and a weatherproof adhesive.

10. The system of claim 1, further comprising a solar cell operative to power the heating element, the J-shaped portion including the cell.

11. A system comprising:

an installed gutter having an elongated water channel and an elongated edge above the channel, the gutter includes at least one of a bracket and a spike-and-ferrule hanger extending over the water channel;

a strand of operating decorative lights; and a J-shaped portion defined via an elongated trough and an elongated leg, the trough having an elongated inner channel, the leg having an elongated inner surface exposed to the inner channel, the J-shaped portion having a first elongated end at the trough and a second elongated end at the leg, the first end having an elongated lip curving toward the inner channel, the lip is longitudinally segmented with a plurality of openings therebetween to accommodate said at least one of a bracket and a hanger, the lip grasping at least a section of the edge such that the J-shaped portion hangs from the gutter, the inner surface having a plurality of decorative light holders stationed along the inner surface, the holders are disposed between the inner channel and the second end, the holders holding the lights such that the lights avoid contact with the gutter, the lights illuminating downward and away from the inner channel.

12. The system of claim 11, wherein the leg having at least one side portion extending beyond the trough, the at least one side portion co-planar with the inner surface.

13. The system of claim 11, wherein the second end having an elongated rib.

14. The system of claim 11, further comprising a block placed into the channel, the block providing stabilizing support to the J-portion.

15. The system of claim 14, wherein the block includes a ramped side.

16. The system of claim 14, wherein the block includes a handle such that the handle can be used to slide the block from the channel when pulled by the handle.

17. The system of claim 11, wherein the trough is longitudinally segmented according to the lip such that the block is visible when the block is in the channel.

18. The system of claim 11, wherein the lip includes at least one of a friction enhanced material and a weatherproof adhesive.

* * * * *